United States Patent [19]

Rünzi

[11] Patent Number: 4,544,294

[45] Date of Patent: Oct. 1, 1985

[54] SHEET SUPPLY APPARATUS FOR TYPEWRITERS, HAVING SLEWING ROLLERS ENGAGING A PLATEN ROLL, AND METHOD

[76] Inventor: Kurt Rünzi, Küsnachterstrasse 59, CH-8126 Zumikon, Switzerland

[21] Appl. No.: 718,836

[22] Filed: Apr. 3, 1985

Related U.S. Application Data

[63] Continuation of Ser. No. 536,863, Sep. 29, 1983, abandoned.

[30] Foreign Application Priority Data

Oct. 6, 1982 [CH] Switzerland ..... 5863/82

[51] Int. Cl.[4] ..... B41J 13/02; B65H 5/26

[52] U.S. Cl. ..... 400/636.2; 400/649; 271/116

[58] Field of Search ..... 400/636.2, 636.1, 637.1, 400/634, 625, 649; 271/9–10, 114, 116, 242

[56] References Cited

U.S. PATENT DOCUMENTS

| | | | |
|---|---|---|---|
| 2,366,206 | 1/1945 | Metzner | 400/636.2 |
| 2,565,295 | 8/1951 | Booten | 400/636.2 X |
| 2,864,484 | 12/1958 | Metzner | 400/636.2 X |
| 3,062,534 | 11/1962 | Benson et al. | 271/114 |
| 3,519,117 | 7/1970 | Smith | 400/636.2 X |
| 4,031,995 | 6/1977 | Blum et al. | 400/636.2 X |
| 4,217,057 | 8/1980 | Nakamura | 400/636.2 X |
| 4,248,415 | 2/1981 | Steinhilber | 271/116 |
| 4,268,021 | 5/1981 | Rutishauser et al. | 400/636.2 X |
| 4,368,994 | 1/1983 | Sweeney | 400/636.2 X |
| 4,416,559 | 11/1983 | Steinhilber | 400/636.2 X |

FOREIGN PATENT DOCUMENTS

| | | | |
|---|---|---|---|
| 513464 | 1/1930 | Fed. Rep. of Germany | 400/636.2 |
| 1569370 | 6/1980 | United Kingdom . | |

*Primary Examiner*—E. H. Eickholt

*Attorney, Agent, or Firm*—Frishauf, Holtz, Goodman & Woodward

[57] ABSTRACT

To provide for feeding of single sheets to an automatic typewriter, output printer or the like, a feed roller (15) in engagement with the topmost sheet (11) of a stack is driven in intermittent movement by a connecting drive train (14, 20, 21, 22, 26, 28, 38, 40) which has as its input a pinion (10) coupled to a gear (3) rotating with the platen (2) of the writing apparatus. The intermittent drive is so arranged that, upon rotation of the platen, the drive train will transmit rotation to the feed roller (15) to feed a topmost sheet to the slewing mechanism (44, 44', 45) of the writing apparatus, and then permit free rotation of the feed roller, as the sheet is being transported by the writing apparatus, positive drive connection between the platen and the feed roller not being re-established until the platen has rotated sufficiently such that its circumferential path is slightly longer than the longest sheet to be fed, to thereby always re-establish feed of a new sheet from a predetermined reference position.

22 Claims, 7 Drawing Figures

FIG. 2
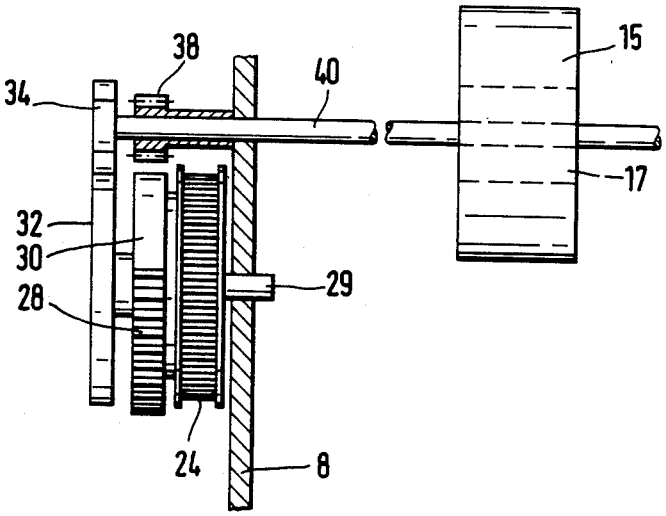
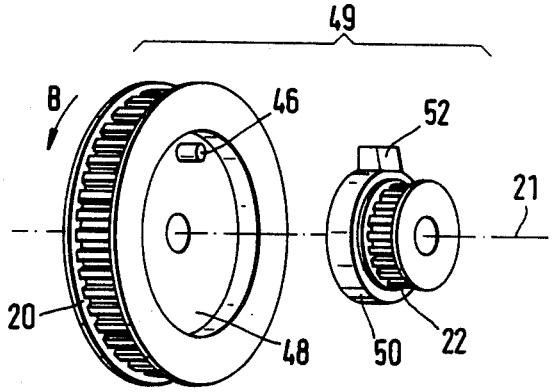
FIG. 4

SHEET SUPPLY APPARATUS FOR TYPEWRITERS, HAVING SLEWING ROLLERS ENGAGING A PLATEN ROLL, AND METHOD

This application is a continuation of application Ser. No. 536,863, filed Sept. 29, 1983 now abandoned.

Reference to Related Publication

British Pat. No. 1,569,370, published June 11, 1980, by the inventor hereof.

Reference to related application by the inventor hereof: Ser. No. 536,862, filed Sept.29, 1983, "SINGLE-SHEET FEED APPARATUS FOR OFFICE-TYPE AUTOMATIC WRITING MACHINES"

The present invention relates to a method and apparatus to feed single sheets to typewriters, output printers of word processors, and similar automatic printing apparatus, in which a platen roller transports sheets to printing positions, and slews the sheets line-by-line as required by the printing.

BACKGROUND

Various types of office machines, particularly typewriters having electrically controlled paper insertion mechanisms, output printers of word processors, computers and the like, are known in which paper is fed to a platen either from a roll or from a zig-zag folded supply. These papers frequently have perforated edges for engagement with a suitable sprocket. Such edge perforations are undesirable in many applications, and apparatus has been developed to cut off the perforated edges. Such cutting operation is comparatively complex, requires additional machinery, and eventual handling for disposal of the cut-off strips.

The increasing use of automatic typewriters, word processors, and the like, makes it desirable to permit output printing to be carried out directly on single sheets. Such single sheets may have letterheads printed thereon, format information required for billing, and the like. Supply of single sheets to typewriter apparatus, which can operate automatically, is difficult since, if single sheets are fed to the typewriter sequentially, inaccuracies with respect to feed of any one sheet become additive. The sheets, although theoretically all of the same size, are subject to tolerances. Slip in the feed, likewise, may become additive with respect to tolerance inaccuracies, so that additive errors of individual line alignment may become troublesome.

It is known and has been previously proposed to feed sheets individually and sense the supply position of the leading edge of the sheet before feeding the sheet. Such an arrangement, while suitable and well known with large printing machines, is difficult to combine with typewriter or typewriter-type printing apparatus, since automatic typewriters and the like have insufficient room to locate the required stop apparatus and the sensors therefor. The space to located photo cells and the like is limited, and the reciprocating movement of a printing element, such as a "daisy-wheel", a jet printer or the like, additionally interferes with use of photo electric apparatus to check proper alignment of sheets which have been supplied or are to be supplied to the printing apparatus. Photo-sensitive units, in which the edge of the sheet interrupts a light beam, thus are practically not applicable due to space limitations. Using the foreward edge of a sheet to sense its position by reflection of a light beam has the disadvantage that the reflection of sheets which may be colored or carry preprinted subject matter at the upper edge is insufficient to permit response of commercial sensing apparatus. The difference in brightness of reflected light is frequently insufficient in order to permit accurate sensing of the front edge of a sheet.

It has previously been proposed to provide a sheet feed apparatus in which a separate drive motor supplies sheets to the platen of a typewriter—see, for example, the referenced British Pat. No. 1,569,370, by the inventor hereof. Use of a separate drive motor, while suitable to supply sheets, is costly, and synchronization of the drive motor with the rotation of a sheet-carrying and sheet supply platen causes difficulty.

THE INVENTION

It is an object to simplify a sheet supply apparatus for individual sheets for office machinery, particularly automatic typewriters, word processors, output printers from computer equipment and the like, which is reliable, provides for accurate feeding of the sheets, and does not require any external power supply.

Briefly, the drive movement to supply a sheet to the platen is derived from the platen itself; a pinion is engageable with a gear on the platen—which may be a gear already present on the platen—and which is coupled to a feed mechanism, for example including rollers, which supply a sheet to the platen. A lost-motion and free-wheeling or overrunning mechanism is included so that, after the sheet has been fed, that is, after the platen has rotated about a predetermined angle of rotation, no further forward feed movement of feed rollers is controlled; the feed rollers themselves can, however, run freely, so that the sheet can move with minimum friction in, and then out of the sheet feeding mechanism of the existing typewriter, output printer, or the like. Positive drive, thus, is interrupted after the platen has rotated from an initial position in sheet-feeding direction for a predetermined angle, so that the sheet is fed over a distance which is less than the length of the sheet itself. The circumferential distance through which the platen can turn before a further feed connection is established is longer than the length of the sheet to be fed, so that each sheet is fed in feed cycles from an initial starting position. Consequently, any alignment errors will not become cumulative.

The sheet feeding system and method have the advantage that the respective single sheets are fed precisely in accordance with their respective alignment, so that any possible inaccuracy in feed of one sheet will not be transferred to another. Consequently, differences in length of the sheets, or possible misalignment of one sheet, will not become additive. Additionally, different format can readily be handled without changing the programming of the machine. No additional motor is necessary for the sheet transport since all movements are directly derived from the printer or typewriter platen, respectively, thus eliminating requirements for additional synchronization arrangements. No electrical connection is necessary for the apparatus, so that it can easily be made as a separate accessory which can be placed on an existing machine, relocated, or removed as desired. The only operative connection which need be severed is disengagement of a single gear wheel.

DRAWINGS

FIG. 2 is a side view of the gearing for the intermittent sheet feeding, together with the drive roller, looked at in the direction of the arrow F of FIG. 1;

FIG. 4 is a perspective, exploded view of a one-way free-wheeling clutch;

DETAILED DESCRIPTION

Figure 1:
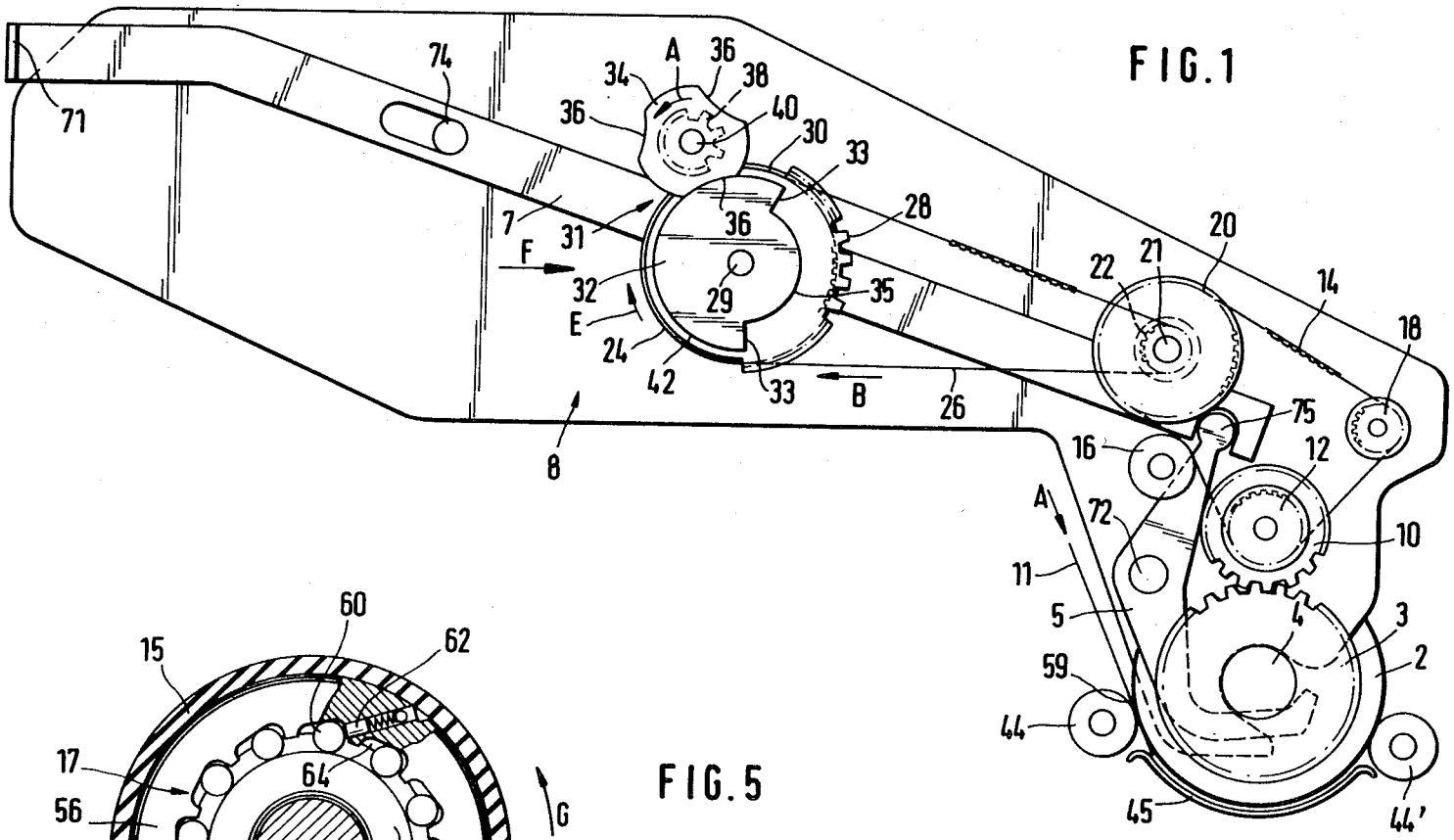
FIG. 1 is a side view of the transport apparatus, illustrating in schematic form the drive connection for intermittent sheet feeding.

The sheet feed and supply apparatus is an attachment element for use with an office machine, particularly automatic typewriters. It can be secured to a moving printing head-type typewriter 1, as best seen in FIG. 7; the platen 2 (FIG. 1) of the typewriter has, as is customary, a gear 3 secured to the shaft 4 of the platen—see FIGS. 1 and 6—such that the gear 3 rotates together with the platen 2 of the typewriter. In accordance with a feature of the invention, the accessory apparatus to feed single sheets includes a pinion or small gear wheel 10 which forms the power drive connection to supply the sheets to the typewriter 1.

To secure the accessory apparatus to the typewriter, a locking lever 5 with a hook recess therein is provided, engaging on both sides of the apparatus around the shaft 4 of the platen 2. The hook 5 can be released by an operating lever 7 which is manually movable and coupled by a link 75 with the locking lever 5. A bolt 74 guides the operating lever 7 which, at the end remote from the engagement with the locking lever 5, is formed with a handle portion 71. By suitable movement of the handle portion 71, which pivots the locking lever 5, shaft 4 can be released or engaged by the accessory mechanism, so that removal and attachment of the accessory sheet feed apparatus is simple. Two such levers 5 and engagement mechanism are provided, one on each lateral side of the sheet supply apparatus.

Figure 3:
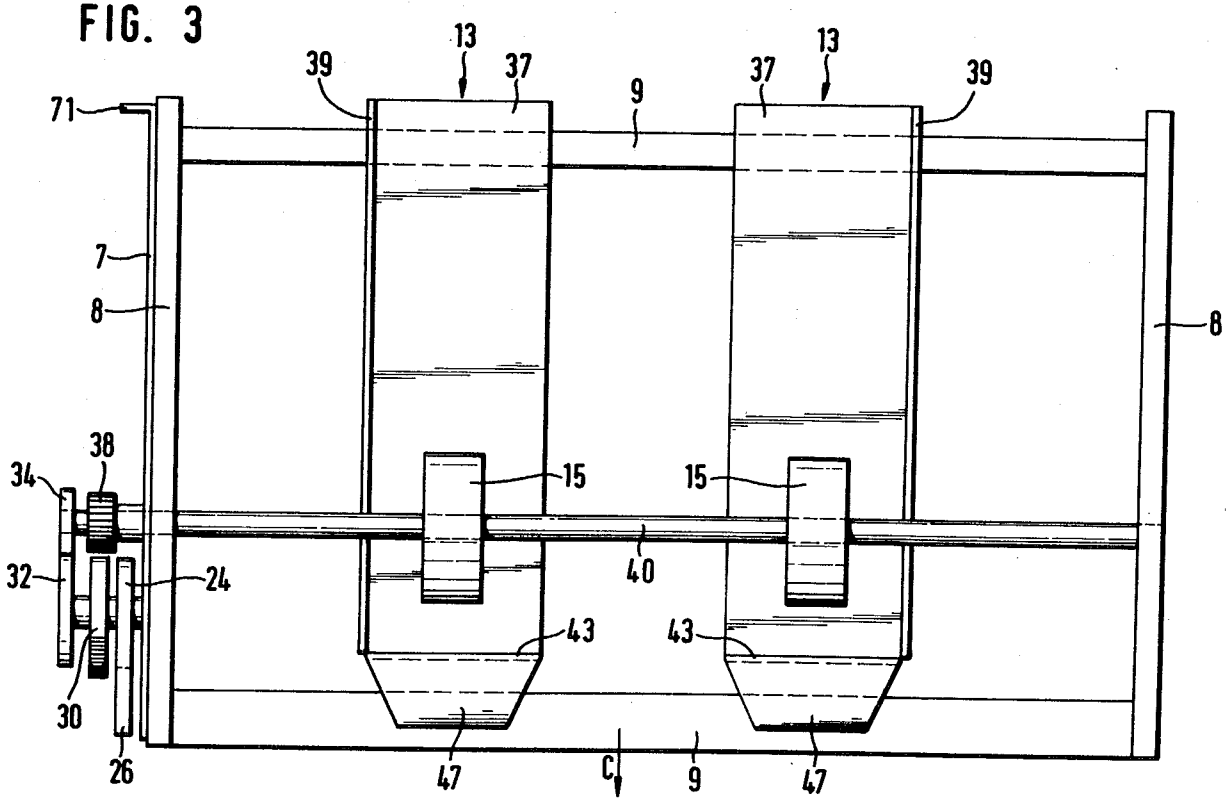
FIG. 3 is a top view of the transport device.
Figure 6:
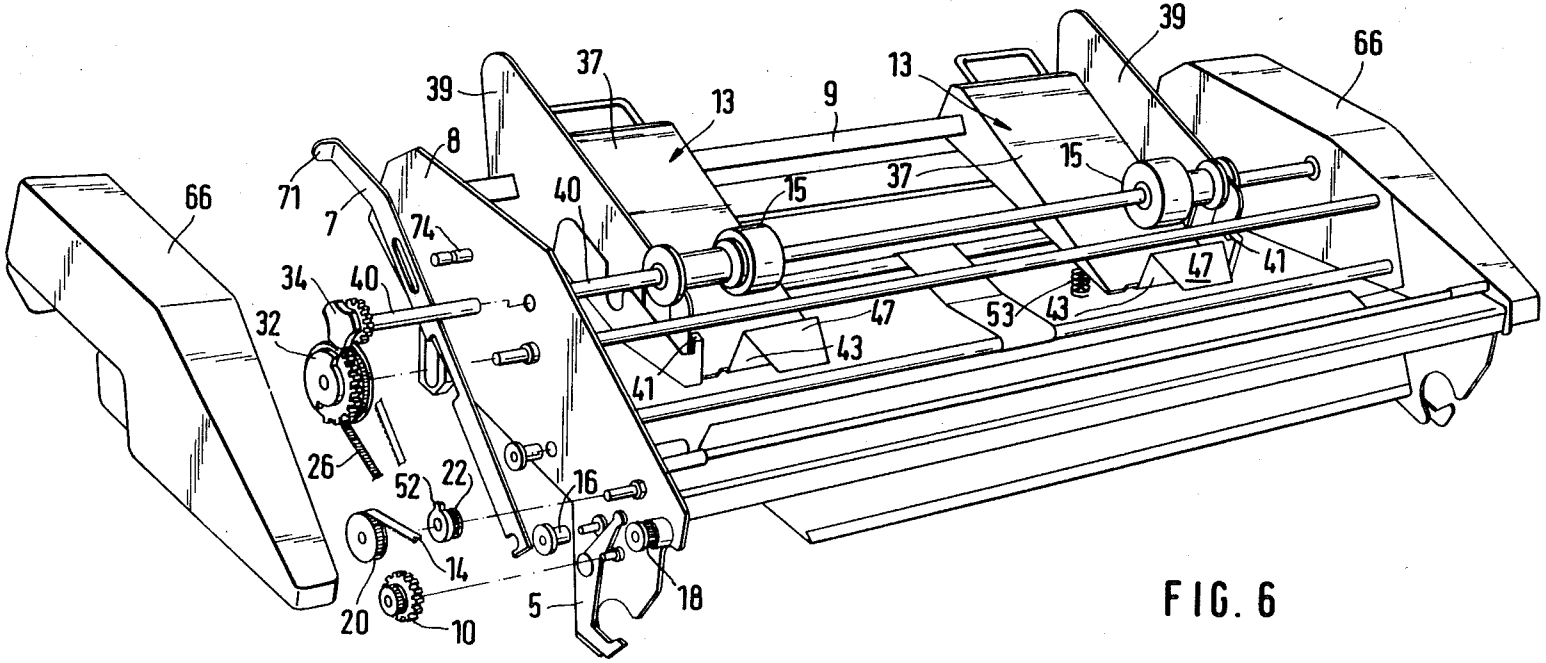
FIG. 6 is a partly exploded, partly phantom view, of the apparatus in the position it would have when coupled to an automatic typewriter or word processor-printer.
Figure 7:
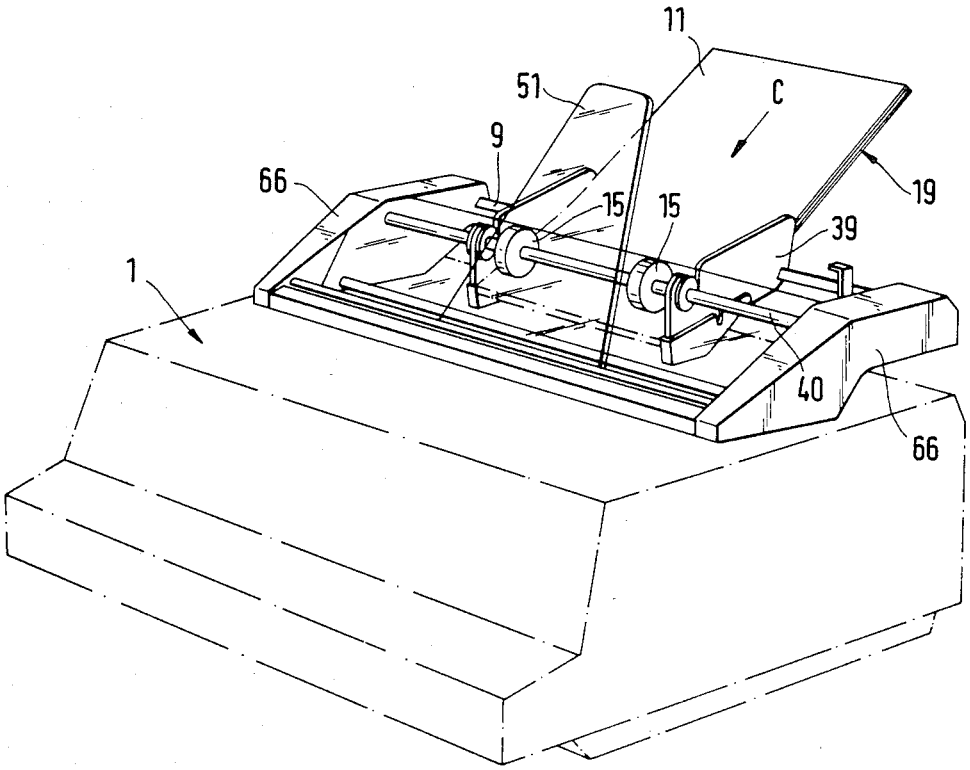
FIG. 7 is a perspective view of the apparatus connected to a moving printing head-type typewriter.

The sheet supply apparatus includes—see FIGS. 3 and 6—a side plate 8 at each lateral end. Side plates 8, when the sheet feed apparatus is attached to a typewriter or the like, extend essentially vertically. They are connected by at least one cross rod 9. The cross rod 9 has at least one rocker plate 13 secured thereon. The rocker plate 13 receives a stack 19 of sheets 11 which are to be fed to the typewriter, printer or the like.

Preferably, and as shown in the drawing, two rocker plates 13 are provided, rotatable or pivotable about the cross rod 9. The rocker plates can receive sheets 11 of different widths and, to this end, are slidable relatively with respect to each other, in accordance with the well known paper guide plates on typewriters. Each one of the rocker plates 13 has a flat bottom portion 37 (see FIG. 6) and a vertical wall 39, and is pressed upwardly by a spring 53. A pull-off roller 15 is located above each one of the rocker plates, frictionally engaging the upper sheet 11 of the stack 19 (see FIG. 7). Each one of the pull-off rollers has a free-wheeling or one-way clutch therein, which is shown in detail in FIG. 5. The arrangement is such that the rollers 15 can be positively driven in one direction, which corresponds to the feed direction of the paper shown by arrow C (FIG. 3). When shaft 40, on which the rollers 15 are located, is stopped, however, the rollers 15 may rotate freely with movement of a sheet 11 therebeneath. Thus, rollers 15 can feed a sheet when shaft 40 is driven; when shaft 40 is not driven, the rollers 15 present practically no drag on a sheet which is pulled from beneath the rollers 15.

Figure 5:
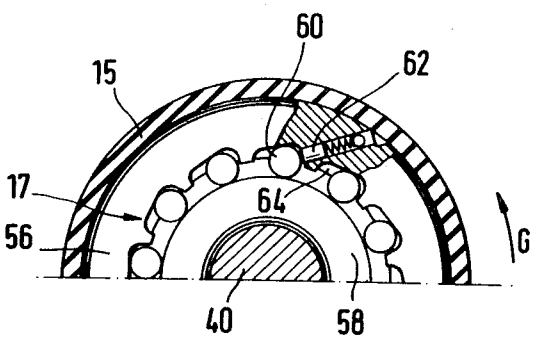
FIG. 5 is a fragmentary sectional view through another form of one-way clutch.

A suitable free-wheeling clutch for the rollers 15 is shown in FIG. 5. This arrangment provides for particularly low friction under free-wheeling conditions, and can be constructed small enough to be suitable for a feed roller on accessory apparatus for a typewriter.

The clutch 17 is combined with the roller 15 which, at the outer side, preferably includes friction material, such as rubber or the like. The rubber material is secured to an outer ring 56 which is spaced from an inner ring 58. Clamping rollers 60 are located between the inner ring 58 and the outer ring 56. Rather than using rollers or pins, balls may be used. The rolling elements—pins or balls—are guided in a cam race 64 formed at the inner circumference of the outer ring 56. The rolling elements 60 are spring-loaded. Spring-loaded pins 62 engage the rolling elements 60 and tend to move the rolling elements 60 against the narrower portion of the cam race 64.

Upon rotation of the shaft 40 in counter-clockwise direction—as shown in FIG. 5—the outer ring 56 will be clamped to the inner ring 58, and thus rotation of the shaft 40 will be transferred through the ring 58, which is secured on shaft 40, to the outer ring 56 and hence to the friction roller 15. If the shaft 40 is stopped, however, the roller 15 can easily continue to rotate in the same counter-clockwise direction, or in clockwise direction, since, then, the rollers 60 can move into the wider portion of the cam race 64, and thus interrupting motion-transmitting connection between the outer ring 56 and the inner ring 58. Arrow G shows the direction of rotation of the shaft 40 to carry along the rollers 15; the rollers 15 can move freely in the same direction of arrow G, even though shaft 40 is stopped.

A sheet of paper 11 is supplied to the platen 2 in this manner:

The gear 10—FIGS. 1 and 6—which is in engagement with the gear 3 coupled to the platen of the typewriter, is rotatably connected to a first gear belt sprocket 12. An endless gear belt 14 engages sprocket 12, and is looped over a deflection roller 18 and a tensioning roller 16 to a second sprocket 20. A third sprocket 22, and secured to a shaft 21 rotating with the second sprocket 20, has a second endless gear belt 26 engaged therewith. The second endless gear belt 26 is looped about a fourth gear belt sprocket 24, secured on a horizontal shaft 29. A gear 28 is coupled to the fourth sprocket 24, the gear 28, however, being only a partial gear element, that is, the gearing thereof extends only over a portion of the full circumference of the gear 28. A suitable circumferential extent is about half the circumference, or slightly less. A cam disk 32 is secured to the sprocket 24. The cam disk 32 cooperates with a locking element 34. The locking element, in disk form, is formed as a locking disk with three part-circular recesses, which have radii corresponding to those of the cam disk 32. A pinion 38 is rigidly secured to the disk 34. Pinion 38 is secured to the shaft 40 to which, also, the sheet rollers 15 are attached. Shaft 40, pinion 38 and disk 34 are rigidly connected for conjoint rotation. Pinion 38 is so constructed that, after rotation about the predetermined uniform angle of rotation of the gear 28, it is engaged thereby, and disengaged therefrom after the rotation. The segmental gear 28, together with the pinion 38, cam disk 32 and the locking disk 34, forms a lost-motion drive 31, which has intermittent movement. The gearing or gear drive of the system 31 is so arranged that, upon continuous rotation of the fourth sprocket 24, the pinion 38 will rotate intermittently. During those periods when the pinion 38 is out of engagement with the gear 28, that is, when no rotation occurs, the pinion 38 is positively locked by engagement of the part-circular recesses 36 of the locking disk 34 with the portion of the cam disk 32. Thus, when the fourth sprocket 34, due to movement of the gear belt 26 in direction of the arrow B is rotated, the gear 38 will not initially move, starting from the position shown in FIG. 1. The gear 28 is not yet in engagement with the pinion 38. Upon continued rotation of the fourth sprocket 24, however, the segmental gear 28 will reach the pinion 38. Simultaneously, the cam disk 32 is in such a position that the locking disk 34 will release the cam 32 so that the locking disk 34, together with the pinion 38, may rotate. A portion 35 of the cam disk 32 has a smaller radius than the portion 42 of the cam disk—see FIG. 1.

When the gear 28 and the pinion 38 come in engagement, a roughly radially extending transition portion 33 of the cam disk 32 will be located about centrally with respect to the adjacent part-circular recess 36 of the locking disk 34. The locking disk 34, thus, may rotate in the direction of the arrow A (FIG. 1). Upon continued rotation of the fourth sprocket 34, the pinion 38 will carry out a predetermined angular rotation which is determined by the length of the segmental gear 28. Thereafter, the locking disk 34 again will reach the region 42 of the camming disk 32, that is, the region having the wider radius, locking the pinion 38, which need not rotate anymore since it is within the region of the gearless portion 30. The locking disk 34, then, will lock the pinion 38 in a precisely predetermined position, and will hold the pinion in that position while the cam 32 continues to rotate.

The above-described sequence will continue. The transfer of movement from the platen 2 to the pinion 38 is positive, since the transfer is carried out over gears or gear belts. Consequently, the relative angular position of a predetermined index point on the platen 2 and of the pinion 34, and hence of a friction roller 15 is insured.

The transmission ratio between the circumference of the platen 2 and rotation of the pinion 38, and hence commanded rotation of the rollers 15, is so arranged that the linear circumferential speed of the platen matches as closely as possible the linear circumferential speed of the feed rollers 15, so that movement will be synchronized when the pinion 38 is in engagement with the gear 28. The paper feed speed in the direction of the arrow A (FIG. 1) thus will correspond to the circumferential speed of the platen 2.

Loss of synchronism upon, for example, manual rotation of the platen to counter the direction of sheet feed, is avoided by including a one-way clutch 49 within the gear train 31. The one-way clutch 49 is shown in exploded view in FIG. 4.

Clutch 49 is located between second and third sprocket disks 20, 22 (FIG. 1). The second sprocket disk 20 is formed with a projecting pin or cam 46 which loosely engages a radially projecting element, such as a cam projection 52 formed on an axial disk 50 secured to and rotating with the sprocket disk or gear 22, in engagement with the gear belt 26. To reduce the axial length, the sprocket or gear wheel 20 can be formed with a cylindrical recess 48 from which the pin 46 projects, the disk 50 with the projecting cam element 52 fitting with the recess 48.

In normal direction of rotation, see arrow B, of the second sprocket disk or gear 20, that is, in the direction of the sheet transport C, the projection 52 is carried along by the pin or projection or cam 46, so that the two sprockets or gears 20 or 22 rotate with the same speed. If, however, the second sprocket or gear 20 is rotated in direction counter that of arrow A, for example upon manual rotation of the platen 2, the element 52 is disengaged and the gear or sprocket 22 remains stationary, and thus the gearing 28, 38 and hence the feed rollers 15. The reverse rotation of the platen 2 usually extends only over several lines, for example to write chemical or mathematical formulae. It is thus usually sufficient to construct the clutch in such a manner that reverse rotation over one revolution of the disk for gear 20 is prevented. Of course, a one-way ratchet may also be used to provide for universal reverse rotation of the gear 20 without carrying along the gear 22.

The one-way clutch 49 can be located at different positions; it is not necessary to place it between the second and the third gears or sprockets 20, 22. For example, it can be located between the gear 10 and the first sprocket 12. The one-way clutch 49 can be constructed in various ways, for example as a claw clutch with substantial play between engaging claws, as a ratchet clutch, or the like.

All the gears or sprockets 12, 20, 22, 24 are formed with suitable projections and teeth to match the gearing of the respective belts 14, 26 so that synchronous transmission of movement is achieved.

Rather than using gear belts 14, 26 and sprockets 12, 20, 22, 24, different gearing could be arranged, for example meshing gears, shafts, bevel gears and the like. Gear belts have the advantage of flexibility and simplicity, while being reliable in operation.

Operation, with reference to FIGS. 1, 6 and 7: A stack 19 of single sheets 11 is located on a rocker plate 13. The front edge of the stack 19 is placed to fit against a stop 43 (FIG. 6) which merges into an upwardly angled extension 47. Two feed rollers 15, secured to the shaft 40 are frictionally engaged with the uppermost sheet 11.

Sheets are fed in feed cycles. Upon rotation of the platen 2, in a feeding direction to provide for feeding of a sheet, pinion 10 will likewise rotate, and the rotary motion is transferred to the shaft 40 and hence to the feed rollers 15—provided the gearing 31 is in the position so that the pinion 38 will be engaged by the segmental gear 28.

Feed of single sheets is obtained by elements 41 which, as well known, engage the corners of the sheet for sheet separation, so that only the uppermost sheet is fed by the rollers 15, feed being effected in direction of the arrow C (FIG. 7). The sheet is deflected downwardly by suitable guide vanes, and will reach the region of the platen 2, which is motor-driven, engaged by at least one platen engagement feed roller 44 (FIG. 1) normally present on typewriters, printers, and the like, deflected about a bowed deflection sheet 45 and supplied to a second engagement roller 44' positioned at the writing side or face of the platen. The sheet 11, thus, has been fed into the nip 59. As soon as the sheet 11 has reached the nip 59, the segmental gear 28 has reached its limit position, and segmental gear 28 can lose engagement with the pinion 38. Sheet 11 is transported forwardly by the platen in accordance with the platen transport mechanism, for example by a slewing motor, e.g. a stepping motor, commonly associated with platens of automatic printers or typewriters. The rollers 15 are no longer driven, but can rotate freely due to the presence of the free-wheeling coupling or clutch 17, which rotates freely in direction of the arrow G. The motor driving the platen will move the sheet to the appropriate line for typing, under control of an operator or a stored program, as well known in connection with automatic typewriters, word processors, or the like. The sheet, now, can be written-on in well-known manner, and can be transported, line-by-line, as required, and as controlled by the writing program. The feed rollers 15 which no longer are driven can rotate freely as long as they are engaged with the uppermost sheet which is being pulled off, and fed by the platen 2. When the uppermost sheet has been fed over a distance corresponding approximately to the end thereof, the feed rollers 15 will engage the next lowermost sheet, which will then be the upper one, and will be stationary. The finished sheet 11 is ejected by movement of the feed roller 45 and fed to a supply holder 51 (FIG. 7).

After the platen 2 has carried out a predetermined number of revolutions, that is, after a discrete surface area of the platen has passed through a given distance—for example sufficient to feed the longest possible sheet which will be used, and a little more, for safety, the feed cycle is terminated. The gearing of system 31 will again bring the segmental gear 28 in engagement with the pinion 38, resulting in renewed rotation of the shaft 40, and hence of the sheet rollers 15, to supply the next sheet 11 during a subsequent feed cycle.

The transmission ratio of the gearing between the platen 2 and the gear 3 connected thereto, and the fourth sprocket or gear 24, is so selected that the pinion 38 will start with renewed rotation only when the longest sheet 11 which can be handled by the apparatus has been fed from beneath the feed rollers 15, so that a certain gap will occur between the first sheet 11 which has been transported and the next subsequent top sheet 11. Since the relationship between the sheets will be precisely sequential, controlled by the platen 2 and the feed rollers 15, any inaccuracies which might result in feed of any specific sheet, or of sheets which are of unequal length, will not become additive. Each newly fed sheet 11 will be supplied under exactly the same starting conditions as any other one. Consequently, the sheet 11 can be fed without scanning by a photo cell or other scanning apparatus, which might determine a leading edge, since the relationship in motion between the platen 2 and the feed transport rollers 15 will be precisely defined. The gearing 37 insures slip-free synchronized movement between the platen 2 and the pinion 38, and hence the feed rollers 15. The system 31 is a positive slip-free drive between the platen 2 and the pinion 38.

The printed stack, supplied to the holder 51, is preferably held thereon at an inclination, the holder 51 having an inclined position in advance of the stack 11. FIG. 7 illustrates the relationship in which the holder 51 is drawn transparent; it may well be a sheet of Plexiglas or similar material.

Control of the movement of the sheet transport is effected solely under movement of the platen 2. It is thus only necessary to so arrange the control system for the drive motor of the automatic typewriter, printer or the like that a predetermined number of rotary steps or, in other words, a predetermined angle of rotation—which may well include several complete revolutions—occurs between sheets which are to be written on, so that sequential sheets will always be fed with precisely the same starting position. Many motors for automatic typewriters are stepping motors, the operating command of which can readily by controlled by programming inherent in a word processor control program, as well known in connection with automatic sequential data recording. A complete sequence, that is, a complete cycle between feeding of a sheet, writing thereon, and feeding of a next sheet, corresponds, then, to a rotation of the platen 2 sufficient to pass the longest possible sheet thereover, and slightly more, for safety, and to insure that the next sheet being fed will be supplied under the same starting conditions as any other one.

Various changes and modifications may be made and features described in connection with any one of the embodiments may be used with any of the others, within the scope of the inventive concept.

Individual sheet separation devices can be conventional or, for example, as described in referenced application Ser. No. 536,862, filed Sept. 29, 1983, by the inventor hereof, entitled "SINGLE-SHEET FEED APPARATUS FOR OFFICE-TYPE AUTOMATIC WRITING MACHINES".

I claim:

1. Method of supplying single sheets in feed cycles to an automatic typewriter apparatus, output printer apparatus, or like apparatus, having a platen (2) rotatable in a sheet feeding direction to transport sheets thereto and thereabout by a sheet slewing mechanism (44, 44', 45) comprising the steps of establishing a positive drive connection between the platen (2) and a supply or feed roller (15) in frictional engagement with a sheet (11) for positively driving the supply or feed roller (15) from the platen through a positive feed path in said sheet feeding direction;

establishing the length of the positive feed path to be shorter than the length of the sheet and extending essentially only from the front portion of the sheet to the sheet slewing mechanism of the apparatus;

permitting the feed roller (15) to rotate freely in feed direction while interrupting positive drive connection between the feed roller (15) and the platen when the sheet has been gripped by the sheet slewing mechanism;

and re-establishing positive drive connection between the platen and the feed roller only after the platen has rotated about an angular extent such that, during a sheet feed cycle, a discrete area of the circumference of the platen has traveled through a path of a predetermined length.

2. Method according to claim 1, wherein the steps of positively driving the supply or feed roller (15) and permitting the feed roller to rotate freely while interrupting positive drive connection between the feed rollers and the platen upon gripping of a sheet comprises engaging a positive drive connection (3, 10, 14, 20, 21, 22, 26, 28, 38, 40) to the feed roller for a limited angular distance of rotation of the platen and interrupting transmission of rotary movement in the transmission path between the platen and the feed roller after the platen has rotated over the predetermined angle;

and re-establishing the drive connection when the platen has rotated sufficiently such that its circumference has traveled a path longer than the length of a sheet.

3. Apparatus for supplying single sheets in feed cycles to an automatic writing apparatus, such as an automatic typewriter, output printer, or the like, in which the writing apparatus has a rotatable platen (2) and a slewing mechanism (44, 44', 45) in operative association with the rotatable platen to transport sheets to and about the platen upon rotation thereof in a sheet feeding direction, said apparatus comprising a supply or feed roller (15) in frictional engagement with a sheet (11) being supplied to the writing apparatus;

a positive drive connection means (3, 10) coupled, respectively, to the platen (2) and to said apparatus for deriving a positive drive connection, rotating in synchronism with the platen upon rotation of the platen in the sheet feeding direction;

and a drive train (12, 14, 20; 21; 22, 26, 24; 28, 38, 40) between the positive drive connection means (10) on said apparatus and the feed roller (15), said drive train including a lost motion (28, 38) which is dimensioned to provide for positive drive of the feed roller to feed the sheet (11) to the slewing mechanism (44, 44', 45) at the beginning of a feed cycle and then, after gripping of the sheet by the sheet slewing mechanism, disengaging to interrupt positive drive connection between the platen (2) and the feed roller, and remaining disengaged until the end of the feed cycle, the platen (2) during each cycle rotating about an angular distance such that a discrete area of the circumference of the platen has traveled through a path of a predetermined length.

4. Apparatus according to claim 3, wherein said drive train includes slip-free drive connection means (12, 14, 20; 21; 22, 26, 24) and the lost motion (28, 30) includes an interrupted motion connection (28, 38) driven by the slip-free drive connection means.

5. Apparatus according to claim 4, wherein the slip-free drive connection means comprises at least one gear belt (14, 26) and sprocket or gear wheels (12, 20; 22, 24) in engagement with said at least one gear belt.

6. Apparatus according to claim 4, wherein the interrupted motion transmission comprises a continuous circumferential gear (38), and a segmental gear portion (28) coupled with said continuous circumferential gear.

7. Apparatus according to claim 6, wherein the continuous circumferential gear (38) comprises a pinion (38) rotatably connected to rotate the feed roller (15);

and said segmental gear portion (28) comprises a segmental gear having a radius larger than said pinion and being coupled to and driven by the slip-free drive connection means.

8. Apparatus according to claim 6, further including a cam segment (32) coupled to rotate with the segmental gear;

and a locking disk (34) coupled to rotate with the continuous circumferential gear and shaped to lock the continuous circumferential gear (38) against rotation unless the segmental gear (28) comes into or is in engagement with said gear (38), said cam segment releasing engagement with the locking disk upon such engagement between the segmental gear portion and the continuous circumferential gear.

9. Apparatus according to claim 8, wherein said cam comprises a segmental circular portion;

and wherein said locking disk comprises a disk element having circumferential depressions of a radius matching the radius of said segment of the cam disk to permit riding of the segment of the cam disk within the depression, while preventing rotation of the disk until the segment has come out of engagement with the respective depression.

10. Apparatus according to claim 3, wherein said device includes locking attachment means (5, 7, 71, 72, 74, 75) severably selectively engageable with the writing apparatus to permit removal of said apparatus as a unit, and formation thereof as an attachment to the apparatus.

11. Apparatus according to claim 10, wherein the locking attachment means includes a hook lever (5) engageable with a shaft (4) on which the platen of the writing apparatus is secured, engagement of the hook lever with said shaft engaging a gear (10) forming part of the positive drive connection means with a gear (3) on the platen (2) to form a positive, synchronous drive connection between rotation of the platen and said positive drive connection means.

12. Apparatus according to claim 3, further including an overrunning clutch (17) between the feed roller (15) and the positive drive connection means to permit free rotation of the feed roller upon interruption of drive by the positive drive connection means when a sheet is being slewed by movement of the platen under control of the writing apparatus and before feeding of a subsequent sheet.

13. Apparatus according to claim 12, wherein said positive drive connection means includes a drive shaft (40) coupled to rotate therewith;

and the overrunning clutch is located on said drive shaft and connecting the circumference of the roller (15) for rotation with said shaft (40) upon rotation thereof, while permitting free running of the roller when said shaft is stopped during interruption of positive drive from the platen (2).

14. Apparatus according to claim 3, further including a one-way clutch (49) included in the positive drive connection means to transmit movement from the platen (2) to the positive drive connection means only in one direction of rotation of the platen.

15. Apparatus according to claim 14, wherein the one-way clutch includes two gears (20, 22) included in the positive drive connection means and forming part thereof;

and selectively engageable projections (46, 52) formed on said gears (20, 22) to transmit rotation upon mutual engagement of said projections, but release engagement upon rotation of one of said projections in a direction opposite to the engaging direction for the distance of almost one revolution of the respective gears.

16. Apparatus according to claim 15, wherein one (20) of said gears is formed with an axial recess;

the other (22) of said gears is formed with an axially located disk (50), said projections (46, 52) being located in said recess and on said disk, respectively, said disk fitting within said recess to form an axially compact unit (49).

17. Single-sheet transport supply apparatus to supply single sheets, particularly paper sheets (11), to a writing apparatus (1), particularly an automatic typewriter, output printer, or the like, having a rotatable platen (2) transporting sheets thereabout and a sheet slewing mechanism (44, 44', 45) for feeding the sheets about the platen upon rotation of the platen;

and a first gear (3) secured to the platen to rotate therewith, said apparatus comprising an engagement gear (10) positioned for engagement with the first gear secured to the platen;

a feed roller (15) positioned for feeding of a sheet (11) from a stack of sheets (19) to the platen and the slewing mechanism thereof;

a drive train (12, 14, 20; 21; 22, 26, 24; 28, 38, 40) connecting the engagement gear (10) to the feed roller, said drive train including an overrunning clutch (17) to permit free rotation of the feed roller (15) upon interruption of positive drive connection between the feed roller and the platen;

a one-way clutch (49) located within said drive train and transmitting rotary movement of the platen via said gear and said engagement gear in one direction of rotation of the platen only;

means (43, 47, 41) establishing a reference position for the topmost sheet (11) of the stack (19);

and wherein said drive train further includes an intermitting motion transmission (28, 38) for transmitting rotation of the platen to drive the feed roller (15) only for a restricted angle of rotation of the platen for feeding a sheet from the reference position to the platen and the slewing mechanism, while permitting free rotation of the feed roller upon continued rotation of the platen and slewing of the paper sheet having been fed thereto about the platen during printing thereon by the writing apparatus, and to provide for initial feed of a subsequent topmost sheet (11) from the stack always from a predetermined position of the stack and after rotation of the platen about a predetermined angular distance, as determined by the transmission ratio of the drive train and the intermittant transmission.

18. Apparatus according to claim 17, wherein the one-way clutch comprises two wheels (20, 22) forming part of said drive train, one of said wheels (20) being formed with a projecting cam (46), and the other of the wheels (22) being formed with an abutment projection, the abutment projection being positioned for engagement against the cam upon one direction of rotation of the platen, and hence of said wheels, while interrupting driving connection of the projection and the cam upon respectively reverse direction of rotation of at least one of said wheels.

19. Apparatus according to claim 17, wherein said apparatus comprises a severable attachment element, adapted for attachment to said writing apparatus;

severable attachment means (5, 7, 71, 72, 74, 75) are located on said apparatus;

and wherein the writing apparatus includes matching engagement means (4) engageable with said severable attachment means to permit, selectively, attachment of said apparatus to the writing apparatus, or release therefrom as a unit, engagement of said attachment apparatus with the writing apparatus effecting matching engagement of the first gear (3) on the platen and the engagement gear (10) on said apparatus.

20. Apparatus according to claim 17, wherein said intermittent motion transmission includes a circumferential pinion (38) and a part-circumferential segmental gear (28), the part-circumferential segmental gear being selectively in engagement with the pinion to transmit motion thereto, and upon further rotation thereof, interrupting transmission of motion to the pinion.

21. Method according to claim 1, wherein said length of the travel of a discrete area of the circumference of the platen is through a length longer than the length of said single sheets.

22. Apparatus according to claim 3, wherein the travel of the discrete area of the platen is over a path longer than the length of a single sheet.

* * * * *